United States Patent [19]

Halstead

[11] Patent Number: 4,690,129

[45] Date of Patent: Sep. 1, 1987

[54] TERMINAL UNIT FOR A BALANCED FLUE

[75] Inventor: Christopher Halstead, Accrington, England

[73] Assignee: Myson Heating Limited, London, England

[21] Appl. No.: 931,918

[22] Filed: Nov. 17, 1986

Related U.S. Application Data

[63] Continuation of Ser. No. 760,770, Jul. 31, 1985, abandoned.

[30] Foreign Application Priority Data

Aug. 2, 1984 [GB] United Kingdom ..... 8419767
Mar. 11, 1985 [GB] United Kingdom ..... 8506260

[51] Int. Cl.[4] ..... F24C 3/00

[52] U.S. Cl. ..... 126/85 B; 98/62; 126/307 A

[58] Field of Search ..... 126/85 B, 307 A, 312, 126/316, 292, 293, 85 R; 98/62

[56] References Cited

U.S. PATENT DOCUMENTS 3,688,759 9/1972 Van Der Goot ..... 126/85 B

FOREIGN PATENT DOCUMENTS

| | | | |
|---|---|---|---|
| 0021281 | 1/1981 | European Pat. Off. | 126/85 B |
| 58864 | 4/1954 | France | 126/85 B |
| 72846 | 1/1958 | France | 126/85 B |
| 357527 | 11/1961 | Switzerland | 126/85 B |
| 677526 | 8/1952 | United Kingdom | 126/85 B |
| 685042 | 12/1952 | United Kingdom | 126/85 B |
| 709276 | 5/1954 | United Kingdom | 126/85 B |
| 833402 | 4/1960 | United Kingdom | 126/85 B |
| 1023996 | 3/1966 | United Kingdom | 126/85 B |
| 1181651 | 2/1970 | United Kingdom | 126/85 B |
| 1268977 | 3/1972 | United Kingdom | 126/85 B |
| 1320943 | 6/1973 | United Kingdom | 126/85 B |
| 1463909 | 2/1977 | United Kingdom | 126/85 B |
| 2027186 | 2/1980 | United Kingdom | 126/85 B |

*Primary Examiner*—James C. Yeung
*Attorney, Agent, or Firm*—Fleit, Jacobson, Cohn & Price

[57] ABSTRACT

A terminal unit for a balanced flue has an air inlet duct (10) and an outlet duct (20) projecting beyond the mouth of inlet duct. An elliptical plate (30) encloses a region around the outlet duct to inhibit combustion products for entering the inlet duct. Alternatively a circular plate (60) could be used.

12 Claims, 7 Drawing Figures

TERMINAL UNIT FOR A BALANCED FLUE

This application is a continuation of application Ser. No. 760,770, filed July 3, 1985, abandoned.

This invention relates to a terminal unit for a balanced flue.

BACKGROUND OF THE INVENTION

A terminal unit is usually mounted in a suitable opening in an external wall of a building. Known forms of terminal unit are usually complex and expensive to construct because they contain a multiplicity of baffles and/or other components. For this reason they tend to be bulky structures which protrude beyond the outer face of the wall to an undesirable extent—in some cases by as much as 10–15 cms. This projection can result in an unsightly outward appearance. Moreover the presence of baffles and/or other components can, in some cases, impose undue resistance to the flow of combustion products away from the unit.

SUMMARY OF THE INVENTION

It is an object of the present invention to provide a terminal unit of such a construction that the above-described problems are at least alleviated.

Accordingly there is provided a terminal unit for a balanced flue, the unit comprising an inlet duct and an outlet duct, wherein an end portion of the outlet duct projects beyond the mouth of the inlet duct to such an extent that, in use, combustion products are expelled from the outlet duct, in a substantially uninhibited manner, even when air currents pass across and/or towards the unit and means are arranged around at least part of the projecting end portion to substantially prevent combustion products, expelled from the outlet duct, entering the inlet duct.

The inlet and outlet ducts may be concentrically arranged or alternatively they could be arranged in side-by-side relationship.

The unit can be constructed so that the mouth of the outlet duct is substantially free from baffles and/or other components which would tend to inhibit flow of the combustion products away from the unit. The unit may be used in conjunction with either a condensing or a non-condensing heat exchange system. The reduced resistance to flow of combustion products away from the unit is particularly beneficial in the case of a non-condensing heat exchanger because the height of the combustion chamber employed in such a system need not be as great as would otherwise be the case if a unit of conventional form had been used.

The inventor finds that a unit in accordance with the present invention allows fumes to be expelled from the outlet duct in a substantially unhindered manner whilst maintaining a satisfactory flow of air into the unit through the inlet duct. Moreover, as compared with hitherto known arrangements, a unit in accordance with the invention can be constructed so as to present a neat, unobtrusive outward appearance.

In a particular example of the present invention, the extent of said projection of the outlet duct beyond the mouth of the inlet duct may be in the range from 20 mm to 50 mm.

Said means to prevent combustion products expelled from the outlet duct entering the inlet duct may comprise a plate which surrounds the projecting end portion in its entirety. At the mouth of the inlet duct the plate may enclose a generally ellipsodial region; alternatively the plate may enclose a generally circular region. Other plate configurations may be envisaged.

If, for example, the inlet and outlet ducts are arranged in side-by-side relationship then the plate may be provided only in the immediate vicinity of the inlet duct and need not completely surround the projecting part of the outlet duct.

BRIEF DESCRIPTION OF THE DRAWINGS

In order that the invention may be carried readily into effect a specific embodiment thereof is now described, by way of example, by reference to the accompanying drawings of which.

DETAILED DESCRIPTION

The terminal units described hereinafter are intended to be installed in a suitable opening in an external wall of a building.

Referring initially to FIGS. 1 to 4, the unit comprises an air inlet duct 10 which is generally flush with the wall surface and surrounds an outlet duct 20 of generally circular cross-section. The inlet duct has a box-like construction defined by side elements (not shown) lining the sides of the wall opening. A protective grille 11 is set in somewhat from the plane of the external wall surface (by about 20 mm in this example). This grille gives the unit a generally pleasing outward appearance.

Figure 1:
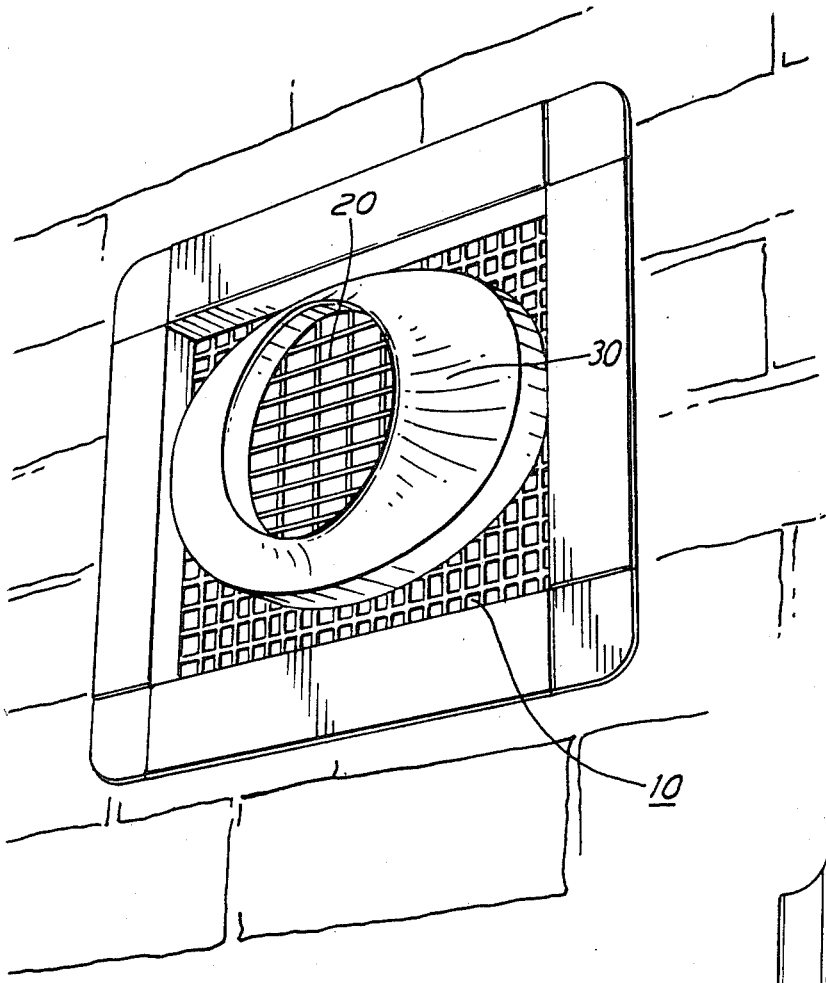
FIG. 1 shows an exterior, perspective view of a terminal unit installed in the wall of a building.

As shown most clearly in FIG. 1, the outlet duct 20 projects beyond the mouth of the inlet duct. A projection of this kind is found to be beneficial since combustion products tend to be expelled from the duct in a relatively unhindered manner even when air currents prevail in the vicinity of the unit.

The inventor finds that when air currents pass across the unit, substantially parallel to the wall surface, a region of relatively low pressure is created at the mouth of the outlet duct, thereby encouraging combustion products to be expelled. Furthermore, since the mouth of the outlet duct is spaced away from a region of relatively high pressure, created in the vicinity of the wall surface when air currents are generally towards the unit, combustion products are expelled from the outlet duct in a relatively unhindered manner, even when the air currents are perpendicular to the wall surface.

In some circumstances, particularly when air currents are parallel to the wall, a projection of the above described kind could result in an excessive intake of air and a consequent reduction in performance of an appliance to which the unit is coupled. In order to reduce the possibility of this happening it is desirable to choose the size of the projection carefully—in the particular case of a unit having an overall width of about 290 mm and an outlet duct 135 mm in diameter, a projection of about 20 mm beyond the mouth of the air inlet duct is found to be beneficial, although projections of up to 50 mm are also found to be satisfactory. It will be appreciated that these dimensions are in no way intended to limit the invention, since it will be evident that the size of the projection will depend, to some extent, on the overall dimensions of the unit itself.

Figure 5:
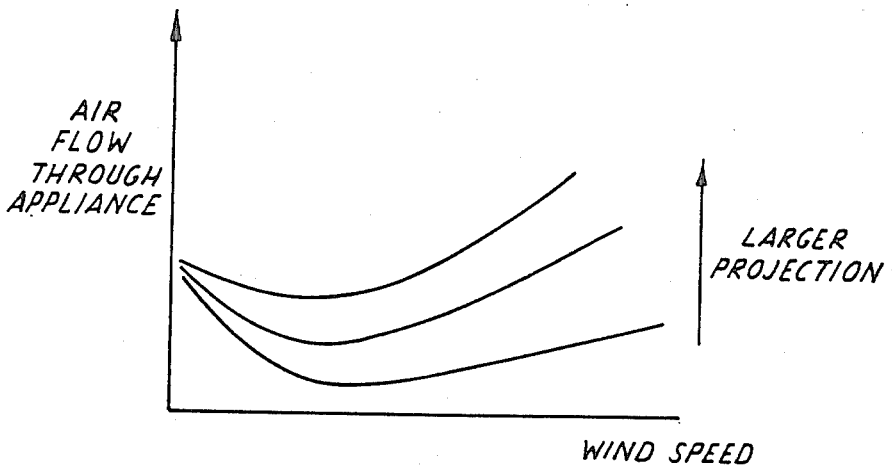
FIG. 5 shows a family of curves useful in understanding operation of the terminal unit.

The family of curves shown in FIG. 5 demonstrates, from a qualitative standpoint, how the variation with wind speed (perpendicular to the wall surface) of the flow of air through an appliance depends on the size of projection used. Generally, the larger the projection the greater will be the air flow. The size of the projection can be set at a value such that a satisfactory flow of air is attained at both high and low wind speeds. The air flow should generally attain at least a minimum value at a critical low wind velocity. The critical velocity chosen tends to be higher, the higher exit velocity of combustion products from the outlet duct.

In some operational conditions it is possible that fumes expelled through the outlet duct could re-enter the unit through the inlet duct. To alleviate this problem the outlet duct is provided with a plate 30 surrounding the outlet duct. The plate, in effect, separates the outlet duct and the inlet duct to such an extent that fumes do not significantly contaminate the relatively pure air entering the unit through the inlet duct, as might happen if the plate was not provided.

The inventors find that the above described arrangement is particularly advantageous since the benefit of a projecting outlet duct is obtained while maintaining a flow of relatively pure air into the unit.

Figure 4:
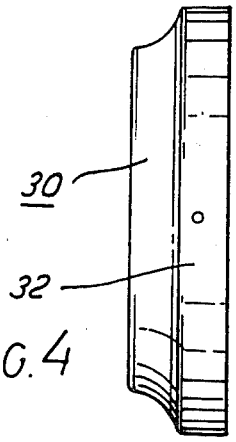
FIGS. 3 and 4 show respectively a section through a plate taken on line AA, of FIG. 2, and a side view of the plate taken in the direction of arrow B.
Figure 2:
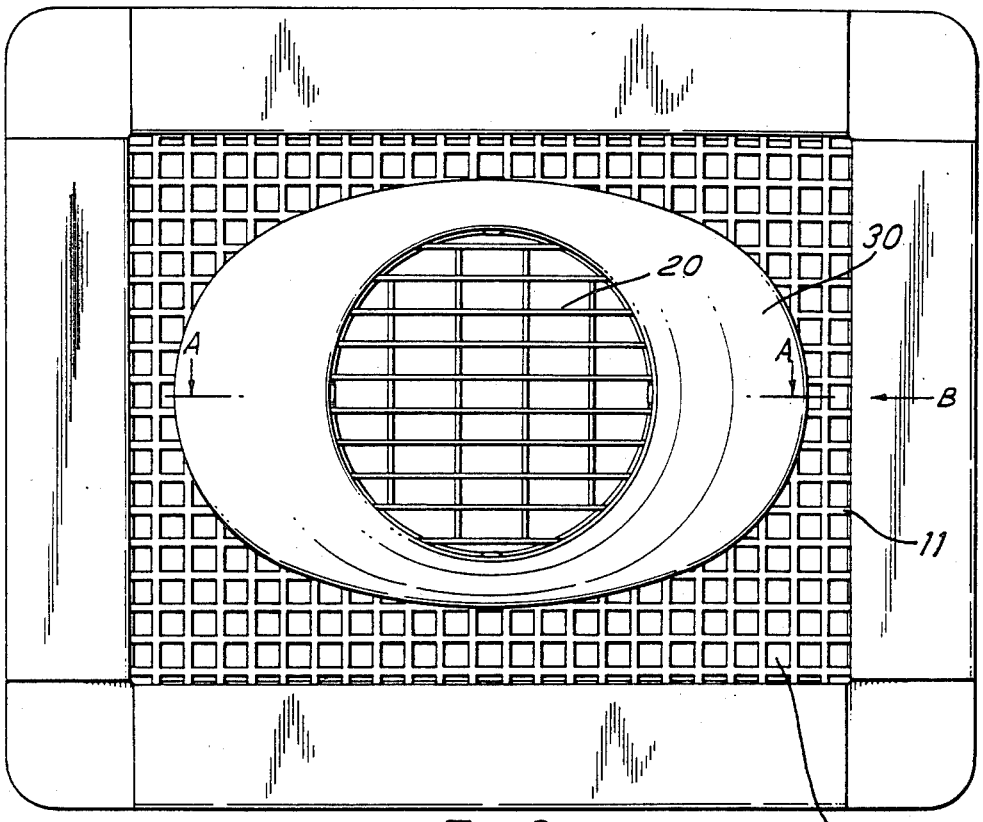
FIG. 2 shows a plan view of the terminal unit.
Figure 3:
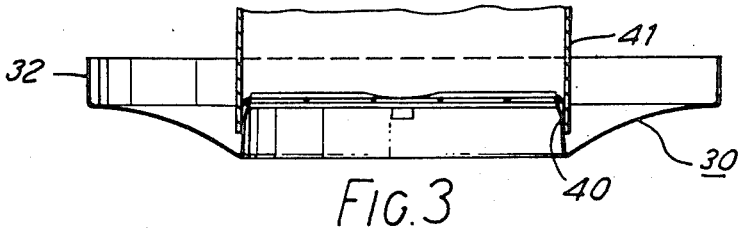

As illustrated in the cross-sectional view of FIG. 3 and the side view of FIG. 4, the plate has a generally flared configuration so as to form, in effect, a skirt enclosing the projecting part of the outlet duct. In accordance with the European Standard, E26, air currents moving across the unit, generally in the vertical direction, are not expected to be significant and so, adjacent to the mouth of the inlet duct, the plate is generally ellipsoidal in cross-section, the major axis of the section being orientated so as to extend substantially horizontally when the terminal unit is correctly installed in a wall.

Figure 6:
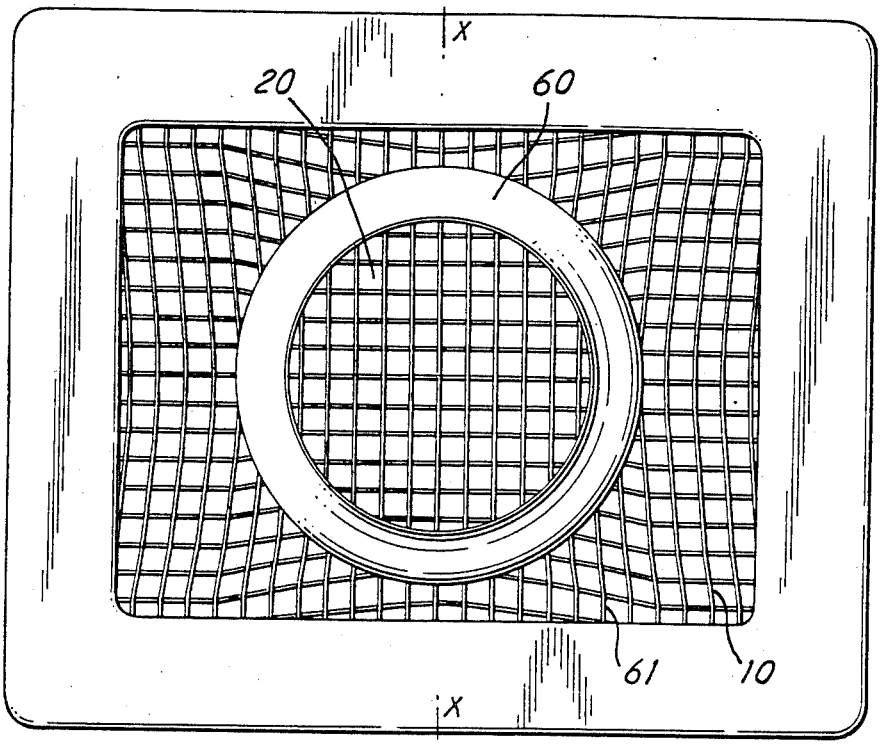
FIGS. 6 and 7 show respectively a plan view of an alternative form of terminal unit and a sectional view, on line BB of FIG. 6, through a plate.
Figure 7:
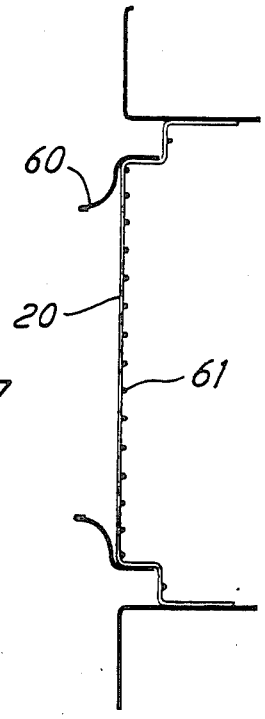

It will be appreciated that other configurations of plate could be used. For example, as shown in FIGS. 6 and 7, the plate 60 may be circular in the region adjacent to the mouth of the inlet duct. Furthermore, although in the embodiments described hereinbefore the inlet and outlet ducts are arranged concentrically this need not necessarily be the case; they could alternatively be arranged in side-by-side relationship. In these circumstances, the plate need not necessarily surround the projecting part of the outlet duct in its entirety.

As illustrated in the sectional view of FIG. 3 plate 30 is formed integrally with a generally tubular re-entrant member 40 which constitutes an end section of the outlet duct. The remainder of the outlet duct, indicated generally at 41, fits closely over member 40 and is thus located centrally in relation to the inlet duct. Plate 30 itself is located and secured in the unit by means of upstanding lugs (not shown) on grille 11 which press against the inner surface of a peripheral rim 32 of the plate. This form of mounting proves to be beneficial since it obviates the need for vanes, or a "spider". It has been found that such intrusions into the region of the air inlet duct tend to disturb the flow of air thereto and so reduce the overall performance of the terminal. It is for this reason that it has been found beneficial to set the grille 11 inside the mouth of the duct.

It will be appreciated that the duct and plate could alternatively comprise discrete piece parts with a suitable interconnection at the inner edge of the plate.

In a yet further arrangement, as shown in FIGS. 6 and 7, the plate is supported on a suitably shaped wire mesh 61 which also serves as a grille for both the inlet and the outlet ducts.

It will be appreciated that a terminal unit in accordance with the present invention benefits from the provision of a projecting outlet duct while maintaining a satisfactory flow of substantially uncontaminated air through the inlet duct. Moreover, the combustion products tend to be expelled in a direction substantially perpendicular to the wall. Thus, a compared with units wherein combustion products are expelled in a direction parallel to the wall, the heating effect of the combustion products on the wall surface is reduced considerably. This is particularly beneficial in the case of buildings constructed from, or clad with, wood.

Further, as compared with hitherto known arrangements, a unit in accordance with the present invention may have a neat, unobtrusive appearance—in the described example the unit projects beyond the outer face of the wall by a few (about 2) cms only.

I claim:

1. A terminal unit for a balanced flue, the unit comprising:

an air inlet duct having an inlet mouth;

an outlet duct having an outlet mouth, said outlet duct projecting beyond said inlet mouth by a distance of from 20 mm to 50 mm so that in use, combustion products are expelled from said outlet duct, in a substantially uninhibited manner, even when air currents pass across, or towards said unit; and a plate which has a flared configuration surrounding said outlet duct and extending from said outlet mouth and towards said inlet mouth such that the perimeter of the flared plate meets the planar portion of the inlet mouth to cover part of the inlet mouth, whereby combustion products expelled from said outlet duct are substantially prevented from entering said inlet duct.

2. A terminal unit according to claim 1 wherein the position of the air inlet duct is such that when the unit is installed in a wall the mouth of the air inlet is substantially flush with or projects only a very small distance from the wall.

3. A terminal unit according to claim 2 wherein the outlet duct is about 135 mm in diameter.

4. A terminal unit according to claim 2 wherein said plate encloses an elliptical region adjacent to the mouth of the inlet duct.

5. A terminal unit according to claim 2 wherein said plate encloses a circular region adjacent the mouth of the inlet duct.

6. A terminal unit according to claim 2 wherein an end section of said outlet duct is formed integrally with said plate.

7. A terminal unit according to claim 2 wherein said inlet and outlet ducts are provided with respective grilles.

8. A terminal unit according to claim 1 wherein the outlet duct is about 135 mm in diameter.

9. A terminal unit according to claim 1 wherein said plate encloses an elliptical region adjacent to the mouth of the inlet duct.

10. A terminal unit according to claim 1 wherein said plate encloses a circular region adjacent the mouth of the inlet duct.

11. A terminal unit according to claim 1 wherein an end section of said outlet duct is formed integrally with said plate.

12. A terminal unit according to claim 1 wherein said inlet and outlet ducts are provided with respective grilles.

* * * * *